US011821118B2

(12) United States Patent
Finnis

(10) Patent No.: US 11,821,118 B2
(45) Date of Patent: Nov. 21, 2023

(54) NONWOVEN FABRIC COMPRISED OF CRIMPED BAST FIBERS

(71) Applicant: BAST FIBRE TECHNOLOGIES INC., Victoria (CA)

(72) Inventor: Jason David Finnis, Victoria (CA)

(73) Assignee: BAST FIBRE TECHNOLOGIES INC., Victoria (CA)

( * ) Notice: Subject to any disclaimer, the term of this patent is extended or adjusted under 35 U.S.C. 154(b) by 251 days.

(21) Appl. No.: 17/029,150

(22) Filed: Sep. 23, 2020

(65) Prior Publication Data

US 2021/0002800 A1 Jan. 7, 2021

Related U.S. Application Data

(63) Continuation of application No. PCT/IB2019/052359, filed on Mar. 22, 2019.

(60) Provisional application No. 62/647,119, filed on Mar. 23, 2018.

(51) Int. Cl.
*D04H 1/425* (2012.01)
*D04H 1/4391* (2012.01)
(Continued)

(52) U.S. Cl.
CPC ..... *D04H 1/425* (2013.01); *D04H 1/43918* (2020.05); *D04H 1/492* (2013.01); *D04H 1/54* (2013.01); *D04H 1/64* (2013.01)

(58) Field of Classification Search
CPC .... D04H 1/425; D04H 1/43918; D04H 1/492; D04H 1/64; D04H 1/54
See application file for complete search history.

(56) References Cited

U.S. PATENT DOCUMENTS 5,393,304 A 2/1995 Vuillaume et al.
8,591,701 B2 11/2013 Sung et al.
(Continued)

FOREIGN PATENT DOCUMENTS

CN 1350456 10/2003
CN 1907185 2/2007
(Continued)

OTHER PUBLICATIONS

Alix et al., Pressure impact of autoclave treatment on water sorption and pectin composition of flax cellulosic-fibres, Carbohydrate Polymers (2014), 102, 21-29, CODEN: CAPOD8; ISSN: 0144-8617.
(Continued)

*Primary Examiner* — Jeremy R Pierce
(74) *Attorney, Agent, or Firm* — Womble Bond Dickinson (US) LLP

(57) ABSTRACT

The invention relates to a nonwoven fabric containing at least a portion of individualized bast fibers with a mean length of greater than about 6 mm which have been treated to produce a crimp, and which can be further coated with one or more thermoplastic polymers to ensure compatibility with QAC sanitizers, and which typically having a reduced level of naturally occurring pectin. The coating and crimp of the bast fibers in these nonwoven fabrics is beneficial to forming a drylaid, airlaid or wetlaid nonwoven fabric that has desirable properties related to performance in a variety of nonwoven product applications.

15 Claims, 6 Drawing Sheets

(51) Int. Cl.

| | |
|---|---|
| ***D04H 1/54*** | (2012.01) |
| ***D04H 1/64*** | (2012.01) |
| ***D04H 1/492*** | (2012.01) |

(56) References Cited

U.S. PATENT DOCUMENTS

| | | | | |
|---|---|---|---|---|
| 8,969,441 | B2 | 3/2015 | Yano et al. | |
| 9,187,848 | B2 | 11/2015 | Graveson | |
| 9,926,654 | B2 | 3/2018 | Baer et al. | |
| 9,926,655 | B2 | 3/2018 | Baer et al. | |
| 9,932,461 | B2 | 4/2018 | Banzashi et al. | |
| 9,949,609 | B2 | 4/2018 | Baer et al. | |
| 10,519,579 | B2 | 12/2019 | Baer et al. | |
| 2010/0136073 | A1* | 6/2010 | Preuss | D06M 11/83 424/404 |
| 2010/0147472 | A1 | 6/2010 | Sung et al. | |
| 2011/0220311 | A1 | 9/2011 | Champion et al. | |
| 2014/0066872 | A1 | 3/2014 | Baer et al. | |
| 2015/0337485 | A1 | 11/2015 | Lee | |
| 2015/0337486 | A1 | 11/2015 | Lee et al. | |
| 2015/0337496 | A1 | 11/2015 | Lee | |
| 2017/0233909 | A1 | 8/2017 | Wright et al. | |
| 2017/0254023 | A1 | 9/2017 | Sumnicht et al. | |
| 2019/0257029 | A1 | 8/2019 | Kühn et al. | |
| 2019/0376011 | A1 | 12/2019 | Cavadeas et al. | |

FOREIGN PATENT DOCUMENTS

| | | |
|---|---|---|
| CN | 1908274 | 2/2007 |
| CN | 101381929 | 3/2009 |
| CN | 103114338 | 5/2013 |
| DE | 102009043428 | 4/2011 |
| EP | 2743388 | 6/2014 |
| JP | 2013036140 | 2/2013 |
| JP | 2018080410 | 5/2018 |
| KR | 20130129321 | 11/2013 |
| WO | WO 99/37834 | 7/1999 |
| WO | WO 99/57353 | 11/1999 |

OTHER PUBLICATIONS

Calamari et al., Structure and properties of kenaf fiber bundles, Book of Abstracts, 211th ACS National Meeting, New Orleans, LA, Mar. 24-28, 1996, CELL-105 Publisher: American Chemical Society, Washington, D. C. CODEN: 62PIAJ.

Colinart et al., Radiative and Hygrothermal Properties of Flax/Viscose Spunlaced Nonwovens, *Journal of Industrial Textiles*, 2016, vol. 46, pp. 1-15.

Das et al. Composite Nonwovens, *Textile Progress*, vol. 44, pp. 1-84 | Received Dec. 19, 2011, Published online: Apr. 27, 2012.

De Guzman et al., Abaca, kenaf and pineapple fibers for nonwoven fabrics, NSTA Technology Journal (1982), 7(1), 77-87, CODEN: NTJODS; ISSN: 0115-9275.

Freivalde, et al., Content of Hemp Fibres and Properties of Nonwovens. *Material Science. Textile and Clothing Technology*. vol. 7, 2012, pp. 84-89. ISSN 1691-3132. e-ISSN 2255-8888.

Ghorpade et al., Microbial retting of banana pseudo stem for extracting textile grade fibers and its applications, Man-Made Textiles in India (2013), (5), 149-153, CODEN: MMTIBW; ISSN: 0377-7537.

Kozlowski, Handbook of Natural Fibres: Types, Properties and Factors Affecting Breeding and Cultivation, Elsevier, Oct. 19, 2012, pp. 72-73. https://books.google.co.uk/books?id=0o1wAgAAOBAJ&printsec-frontcover&source-gbs_ntb#v-onepage&f-false.

Li et al., Surface modification of kenaf fiber and application of it on polypropylene composite, *Gongcheng Suliao Yingyong* (2014), 42(2), 6-10, CODEN: GSYOAG; ISSN: 1001-3539.

Meijer et al., The Pectin Content As A Measure Of The Retting And Rettability Of Flax, *Industrial Crops and Products*, vol. 4, Issue 4, Dec. 1995, pp. 273-284.

Miao et al., Biodegradable mulch fabric by surface fibrillation and entanglement of plant fibers, *Textile Research Journal* (2013), 83(18), 1906-1917, 12 pp. CODEN: TRJOA9; ISSN: 0040-5175.

Parikh et al., Thermoformable automotive composites containing kenaf and other cellulosic fibers, Textile Research Journal (2002), 72(8), 668-672, CODEN: TRJOA9; ISSN: 0040-5175.

Parikh et al., Improved chemical retting of kenaf fibers, Textile Research Journal (2002), 72(7), 618-624, CODEN: TRJOA9; ISSN: 0040-5175.

Ramaswamy et al., Effect of bacterial and chemical retting on kenaf fiber quality, Textile Research Journal (1994), 64(5), 305-8, CODEN: TRJOA9; ISSN: 0040-5175.

Sun et al., Production practice of wet-laid nonwovens of flax tow, *Fangzhi Daobao* (2009), (5), 93-94 CODEN: FDAABB; ISSN: 1003-3025; Chinese.

Yu et al., Treatment and characterization of kenaf for nonwoven and woven applications, International Nonwovens Journal [online computer file] (2000), 9(4), 29-33, CODEN: INOJEA; ISSN: 1527-2494 http://www.inda.org/subscrip/inj99_4/winter00.pdf.

* cited by examiner

NONWOVEN FABRIC COMPRISED OF CRIMPED BAST FIBERS

CROSS-REFERENCE TO RELATED APPLICATIONS

The present application is a U.S. Continuation application and claims priority to and the benefit of International Patent Application PCT/IB2019/052359, filed Mar. 22, 2019, and U.S. Provisional Patent Application No. 62/647,119, filed Mar. 23, 2018. The disclosures of each of the applications noted above are incorporated herein by reference in their entirety.

FIELD OF THE INVENTION

The present invention relates to nonwoven fabrics containing at least a portion of naturally occurring cellulosic fibers. More specifically, the present invention relates to nonwoven fabrics containing bast fibers.

BACKGROUND

Cellulosic fibers, sourced from plants, have long been used to produce both traditional textile woven and knit fabrics, as well as nonwoven textiles. In general, naturally occurring cellulosic fibers are of three basic types: seed fibers such as cotton and kapok, leaf fibers such as abaca and sisal, and bast fibers such as flax, hemp, jute and kenaf. The seed fibers are known for softness, and that in combination with the length of cotton fibers made them highly desired for the manufacture of yarns and fabrics, particularly for clothing. Bast and leaf fibers, being generally more coarse and stiff have historically tended to be used more for cordage, netting and matting.

Along with animal hair and fibers, and silk, the naturally occurring cellulosics were the source of fibers for textile processing for many centuries. And through those centuries textile and fiber development has been motivated by a desire to modify these materials to provide new or augmented properties or to improve processing efficiency. While much of this relied upon mechanical means to improve fiber processing or husbandry to improve fiber properties, chemistry was also used to improve fiber aesthetics, such as through dyeing, and softness, such as through scouring or retting to remove certain chemicals associated with the surface of natural fibers.

There remained both need for and scientific interest in fibers that had properties and economics that were beyond what had been achievable with natural fibers. The invention of rayon in 1846 marked the beginning of synthetic fiber development. Using nature as an inventive prompt, rayon, a regenerated cellulose, was developed to be a more cost effective alternative to silk fibers. In the 1900's, the development of synthetic fibers based on petrochemicals led to such industry changing inventions as polyamide, polyester, polyaramid, and polyolefin fibers, to name some major examples. The list of synthetic fibers with properties that are specific to their polymer chemistry has supported the expansion of fiber-based materials in common use across the full spectrum of human industry. And with that have come concomitant improvements in textile type products that have been in use for centuries as well as new products spawned by $20^{th}$ and $21^{st}$ Century technology demands.

Traditional textile fabric formation technology has long relied upon carding as a means to separate, individualize, and align fibers as part of the yarn-making process that is core to weaving and knitting of such fabrics. Indeed, the essential aspects of carding, repeated combing of a fiber bundle, remain the same, while industrialized improvements have led to increased processing speeds with greater final product uniformity and improved cost of manufacturing.

High speed carding of fibers supported the expansion of nonwoven textile technology and the development of affordable single-use fiber-based products, such as disposable surgical gowns and infant diapers and filters. While other nonwoven technologies that allow the production of nonwoven fabrics directly from petroleum sourced polymer resins, such as spunbond and meltblowing, have gained a strong position in the nonwoven textile industry and the commercial products from that industry, there remains a need and desire for products produced via the carding process.

Among the advantages of carding versus spunbonding for example, is the ability to readily blend two or more types of fibers together for the purpose of producing fabrics with functional benefits that are derived from each fiber type in the blend. For example, strong but hydrophobic polyester fibers might be blended with weaker but hydrophilic rayon fibers to produce a nonwoven fabric that is stronger than an equivalent rayon nonwoven but has the ability to readily absorb fluids.

Nonwoven textile technology in specific has long been valued for the capability to produce fiber-based products with targeted functionalities at favorable price points. The ability to blend selected fibers in the production of certain types of nonwoven manufacturing processes promotes a strong need for and interest in both natural and synthetic fibers to produce nonwoven fabrics with particular performance and aesthetic properties. Further, while synthetic fibers maintain a substantial presence in the textile industry, sustainability and carbon footprint issues that are prevalent topics in many aspects of industry today are also a focus in both the traditional and nonwoven textile industries.

To that end, cellulosic types are the natural fibers that most preferred in nonwoven textile manufacturing. Cotton is the most common of these used in traditional textiles, but cotton fibers are not compatible with the current high speed cards used to produce drylaid nonwoven textiles. Wood pulp is another cellulosic fiber used in nonwovens, but it has seen limited use beyond specialty papers and a specific type of nonwoven technology referred to as conforming, where pulp fibers are blended in a stream of forming fibers spun from a thermoplastic polymer melt to make absorbent products, such as described in U.S. Pat. No. 4,100,324 to Anderson et al., and others assigned to Kimberly-Clark.

Bast fibers are substantially straight as recovered from the plant-source. However, most nonwoven processing, particularly drylaid techniques, such as carding, require a level of fiber-to-fiber cohesion to support high speed processing with good efficiency and resulting fabric properties. In addition to surface friction, this cohesion relates to a type of 3-D geometry in the fiber shape, readily described as undulations or waviness along the length of individual fibers. In synthetic fiber manufacturing, the geometric property of crimp, is imposed on the fibers. In nature, genetics and growth conditions induce a type of crimp, represented as convolutions, or "twisted ribbon" in cotton fibers, and a coiled configuration in wool, as examples. Particularly in nonwoven processing, fiber crimp is known to have an impact on production efficiency, and resulting fabric properties such as fabric bulk, bulk stability, and abrasion resistance, to name a few. Additionally, certain nonwoven processing techniques require some minimum fiber length in order to both process at acceptable efficiencies and to provide good functionality to the resulting fabric.

Nonwoven web forming methods for natural and man-made staple fibers include wet forming and dry formation. Wet forming is similar to the paper making process and accommodates natural fibers with a typical length of 6-10 mm long and wood fibers that are 2-4 mm long.

The dry formed nonwoven process is outlined in [FIG. 1]. It Bales of fiber 2 are introduced by conveyor 4 to a mixing hopper 6 and are intimately blended 8. Blended fibers are pneumatically conveyed 10 and transferred by feed roll 14 into the dry card 16. The carded web of fibers then navigates through a series of worker and stripper rolls and when aligned they are removed from the card by a doffer roll 18. The fiber mat 20 is then conveyed into formation equipment such as hydroentangling [FIG. 2] or needle punching equipment [FIG. 3].

When hydroentangling [FIG. 2], fiber from the card 22 is compacted 24 and pre-wet 26 and then passed between high pressure water jets 28 which bond the fibers together into a mat 30. The bonded mat is then dewatered via suction jets 32 and passed over a rotating drum with a fabric-forming wire mesh 34 and then through a gas fired dryer 36. Finished nonwoven cloth is rolled on a fabric winder 38.

When needle punching [FIG. 3], fiber from the card 40 is conveyed under a needle board 42 that rapidly passes the needles through the fiber mat until the fibers are bound. Needled felt is removed from the needle board by a stripper plate 44 and then passed through drawing rollers 46 on its way to final fabric rolling.

Accordingly, there is a need for a nonwoven fabric which employs natural bast fibers in concentrations up to 100% by weight, having a mean fiber length of greater than 6 mm with improved fiber-to-fiber cohesion to aid processing and fabric properties.

SUMMARY OF THE INVENTION

It is a known feature of bast fibers that the fibers are naturally straight and exhibit poor fiber-to-fiber cohesion due to a lack of natural crimp, resulting in less than optimum processing of those fibers when employed in certain nonwoven fabric forming processes. Those processes rely upon fiber-fiber contact in the formation of the randomized array of fibers form the basic architecture of a nonwoven fabric, and thereby contributing to strength and integrity in the final fabric form. Where fibers are straight and smooth, insufficient surface friction of those fibers can allow excessive loss of fibers as waste during manufacturing. Additionally, straight fibers may dissociate from other fibers in the resulting random array of fibers, thereby resulting in an fabric architecture that has reduced strength and integrity.

In certain embodiments, the present disclosure provides solutions to address the above-noted shortcomings of bast fibers for use in the formation of nonwoven fabrics, by utilizing a nonwoven fabric which incorporates at least a minor portion of natural bast fibers which have been treated to provide a crimp level of at least 1 crimp per cm of fiber length on average, and which may have as many as 8 crimps per cm of fiber length.

It is an aspect of the present disclosure that the majority of the crimped bast fibers in the nonwoven fabric so produced and exhibiting a crimp level have a mean length of at least 6 mm.

It is a further aspect of the present disclosure that the bast fibers described, in all forms, have been treated such that the natural pectin, which adheres the individual fibers together in bundles as recovered from the plant source, has been removed in sufficient measure that the bast fibers are individualized as used in the nonwoven fabric forming processes to produce the nonwoven fabric.

It is a feature of the means of imposing said crimp level that a given single fiber of less than 1 cm may have at least 1 crimp along that length, as the mechanical or chemical treatment to impose the crimp is a bulk process rather than an individual fiber treatment. Such crimp is associated with improved processing of these crimped bast fibers through nonwoven fabric forming processes, including drylaid, airlaid and wetlaid, with resulting improved fabric properties in the products of that processing.

In a further embodiment, the bast fiber nonwoven fabric may contain crimped bast fibers from more than one source of natural bast fiber.

It is an embodiment of the present disclosure that some portion of bast fibers in a bast fiber nonwoven fabric of the invention may have a crimp level of less than 1 crimp per centimeter of fiber length.

In a preferred embodiment of the present disclosure, the bast fiber nonwoven fabrics comprise crimped bast fibers at a level of at least 5% to 95% of those bast fibers on weight of the fabric, where the balance of the fabric weight is 95 to 5% of other natural or synthetic fibers, and where those fibers may be a single type of fiber or a blend of two or more fiber types. Certain embodiments of the bast fiber containing nonwoven fabrics of the invention, where the bast fibers have about 1-8 (or about 1 to 4) crimps per cm on average, demonstrate improved bulk and bulk stability over similar fabrics produced using substantially straight bast fibers.

It is a preferred embodiment of the present disclosure that the bast fiber nonwoven fabric may be produced by methods of forming that include drylaid, or airlaid, or wetlaid processing. It is known in the industry that the terms drylaid, airlaid or wetlaid, which may be rendered as dry-laid, air-laid or wet-laid, are broad in meaning and that each incorporates a variety of equipment, processes and means. The use of drylaid, airlaid, and wetlaid are not limiting and each do not define a single process for means of manufacturing.

It is a further aspect of the instant disclosure that the product of the drylaid, airlaid or wetlaid fabric forming process may be bonded, also sometimes called consolidated or stabilized, by thermal, mechanical, or chemical means to provide some of the final physical and aesthetic properties of the bast fiber nonwoven fabric included herein.

Thermal bonding means include, but are not limited to, thermal point bonding, through air bonding, calendering. Mechanical bonding means include, but are not limited to, needlepunch or hydroentangling. Adhesive bonding means include liquid adhesive applied by means including, but not limited to, dip-and-squeeze, gravure roll, spray and foam, and also include hot-melt applications, and adhesive powders applications.

Bast fibers utilized in this disclosure can be individualized via mechanical or chemical cleaning.

It is an embodiment of the present disclosure that the bast fiber nonwoven fabric of the present invention may contain bast fibers that have been coated with a polyester resin, and/or a polyester thermoplastic resin, and/or a biodegradable polyester thermoplastic resin.

It is an aspect of the present invention that the bast fibers have been coated to ensure compatibility with sanitizing liquids commonly used in surface cleaning industries such as Foodservice and other the Away-From-Home cleaning segments. It is well known in the Away-From-Home cleaning industries that nonwoven fabric containing cellulosic fibers are not compatible with the industry leading sanitizer: Quaternary Ammonium (QAC). QAC binds to untreated cellulose fibers thereby neutralizing the sanitizing liquid which renders the QAC useless.

It is a preferred embodiment of the present invention that the bast fiber nonwoven fabric of the present invention may contain bast fibers that are straight or have a crimp level of at least 1 crimp per centimeter, where those fibers have been coated with at least one thermoplastic polymer, for the purpose of providing QAC sanitizer compatibility.

It is an aspect of the present invention that the coating of the bast fibers with at least one thermoplastic polymer improves compatibility of the subsequent QAC when it comes in contact with the fibers of the nonwoven fabric when compared to those bast fibers that have not been coated with the thermoplastic polymer prior to the QAC contact. The thermoplastic polymer coating acts to reduce the nullifying effect on the QAC as caused by interaction with the surface of uncoated bast fibers.

The present disclosure includes, without limitation, the following embodiments.

Embodiment 1

A nonwoven fabric comprising crimped plant based fibers which have a mean length of greater than about 6 mm.

Embodiment 2

The nonwoven fabric of any preceding embodiment, wherein the plant based fibers are bast fibers.

Embodiment 3

The nonwoven fabric of any preceding embodiment, wherein the plant based fibers are extracted from flax, hemp, jute, ramie, nettle, Spanish broom, kenaf plants, or any combination thereof.

Embodiment 4

The nonwoven fabric of any preceding embodiment, wherein the fibers have been treated chemically or mechanically to impart a planned crimp of at least about 1, and up to about 8, crimps per centimeter.

Embodiment 5

The nonwoven fabric of any preceding embodiment, where said crimped bast fibers have been cleaned to remove naturally occurring pectin.

Embodiment 6

The nonwoven fabric of any preceding embodiment, wherein the nonwoven fabric comprises 5-49% by weight of the crimped bast fibers.

Embodiment 7

The nonwoven fabric of any preceding embodiment, wherein the nonwoven fabric comprises 51-100% by weight of the crimped bast fibers.

Embodiment 8

The nonwoven fabric of any preceding embodiment, further comprising natural staple fibers, man-made staple fibers, or a combination thereof, the staple fibers being crimped or uncrimped.

Embodiment 9

The nonwoven fabric of any preceding embodiment, where the nonwoven fabric is a dry laid, air laid, or wet laid nonwoven fabric.

Embodiment 10

The nonwoven fabric of any preceding embodiment, where the nonwoven fabric is bonded by one or more of thermal bonding, mechanical bonding, and adhesive bonding.

Embodiment 11

The nonwoven fabric of any preceding embodiment, where the thermal bonding includes one or more of calendering, thermal point bonding, through-air bonding, and sonic bonding.

Embodiment 12

The nonwoven fabric of any preceding embodiment, where the mechanical bonding includes one or both of needlepunching and hydroentangling.

Embodiment 13

The nonwoven fabric of any preceding embodiment, wherein the adhesive bonding includes one or more of coating, spraying, dip-and-squeeze, gravure roll, foam bonding, powder bonding, and hot melt adhesive application.

Embodiment 14

A bast fiber nonwoven fabric comprising at least about 5% bast fibers, where said bast fibers have a mean length of greater than about 6 mm and are coated to render the fiber compatible with quaternary ammonium (QAC) based sanitizers.

Embodiment 15

The bast fiber nonwoven fabric of any preceding embodiment, wherein said coated bast fibers have been coated with a thermoplastic resin.

Embodiment 16

The bast fiber nonwoven fabric of any preceding embodiment, wherein said coated bast fibers have been coated with a polyester thermoplastic resin.

Embodiment 17

The bast fiber nonwoven fabric of any preceding embodiment, wherein the polyester thermoplastic resin is biodegradable.

Embodiment 18

The bast fiber nonwoven fabric of any preceding embodiment, wherein the coating improves the surface compatibility of the bast fibers with said quaternary ammonium (QAC) based sanitizers.

Embodiment 19

The bast fiber nonwoven fabric of any preceding embodiment, where said thermoplastic resin coating does not degrade the antimicrobial activity of said quaternary ammonium (QAC) based sanitizers.

Embodiment 20

The bast fiber nonwoven fabric of any preceding embodiment, where the nonwoven fabric is a drylaid, airlaid or wetlaid nonwoven bonded by one or more of thermal bonding, mechanical bonding, and adhesive bonding.

Embodiment 21

The bast fiber nonwoven fabric of any preceding embodiment, where said bast fibers have a mean length greater than about 6 mm and are chemically or mechanically treated to impart a crimp level of about 1 to about 8 crimps per centimeter.

Embodiment 22

The bast fiber nonwoven fabric of any preceding embodiment, wherein the coated bast fibers have not been treated to impart crimp to said fibers.

Embodiment 23

The bast fiber nonwoven fabric of any preceding embodiment, where said level bast fibers are blended with at least one type of natural or synthetic staple fibers at a level of 5-49% bast fibers by weight.

Embodiment 24

The bast fiber nonwoven fabric of any preceding embodiment, where said bast fibers are blended with at least one type of natural or synthetic staple fibers at a level of at least about 51-100% of said bast fibers by weight.

Embodiment 25

The bast fiber nonwoven fabric of any preceding embodiment, where said bast fibers have been treated to remove naturally occurring pectin.

Embodiment 26

A method of forming a bast fiber nonwoven fabric, comprising:
treating bast fibers having a length of at least about 6 mm to impart a crimp level of about 1 to about 8 crimps per centimeter, wherein said treatment is a mechanical or chemical treatment of said bast fibers; and forming a nonwoven fabric comprising at least about 5% by weight of said treated bast fibers.

Embodiment 27

The method of any preceding embodiment, wherein said forming step comprises a drylaid process, an airlaid process, or a wetlaid process.

Embodiment 28

The method of any preceding embodiment, further comprising bonding the nonwoven fabric by one or more of thermal, mechanical, and adhesive bonding.

Embodiment 29

The method of any preceding embodiment, wherein said thermal bonding includes at least one of calendering, thermal point bonding, through-air bonding, and sonic bonding.

Embodiment 30

The method of any preceding embodiment, wherein said mechanical bonding includes at least one of needlepunching and hydroentangling.

Embodiment 31

The method of any preceding embodiment, wherein said adhesive bonding includes at least one of coating, spraying, dip-and-squeeze, gravure roll, foam bonding, powder bonding, and hot melt adhesive application.

These and other features, aspects, and advantages of the disclosure will be apparent from the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise. Other aspects and advantages of the present invention will become apparent from the following.

BRIEF DESCRIPTION OF THE DRAWINGS

In order to provide an understanding of embodiments of the invention, reference is made to the appended drawings, in which reference numerals refer to components of exemplary embodiments of the invention. The drawings are exemplary only, and should not be construed as limiting the invention. The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION OF THE INVENTION

Figure 1:
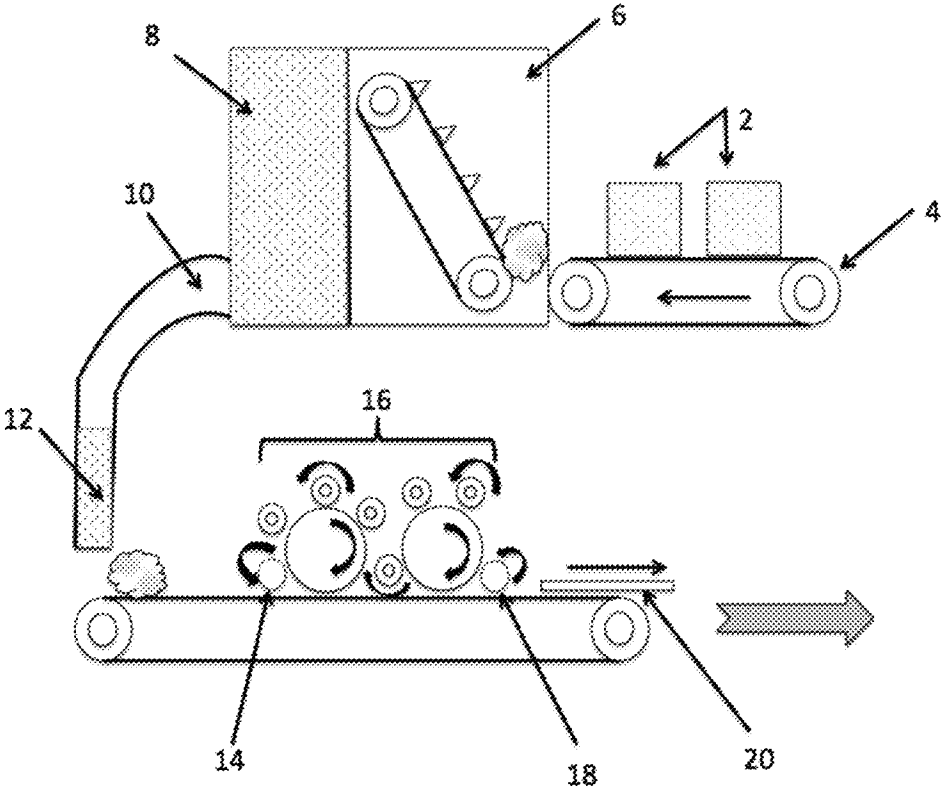
FIG. 1 is a schematic illustration of a method of forming a nonwoven fabric.
Figure 2:
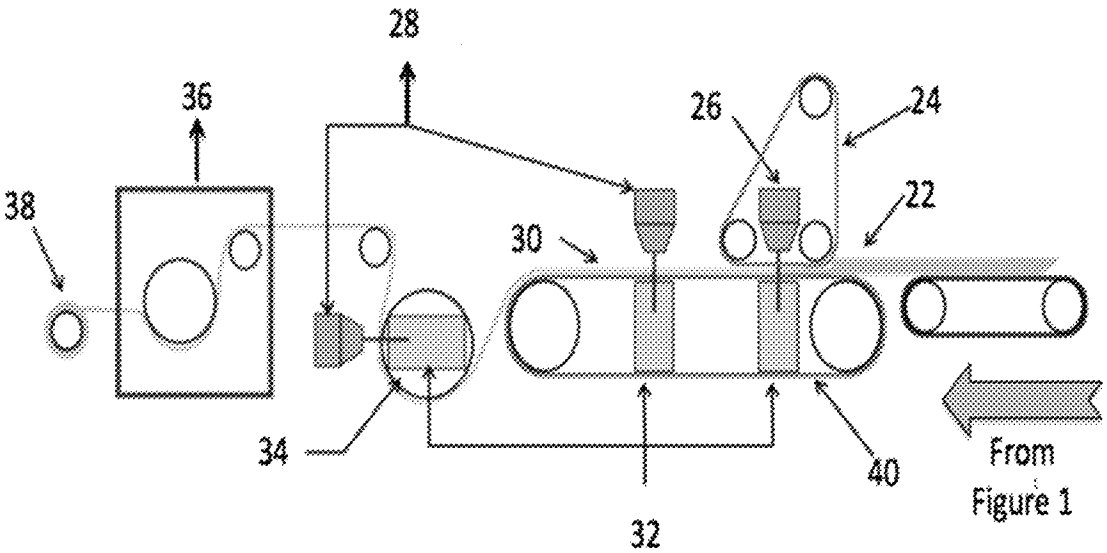
FIG. 2 is a schematic illustration of a method of hydroentangling a nonwoven fabric.
Figure 3:
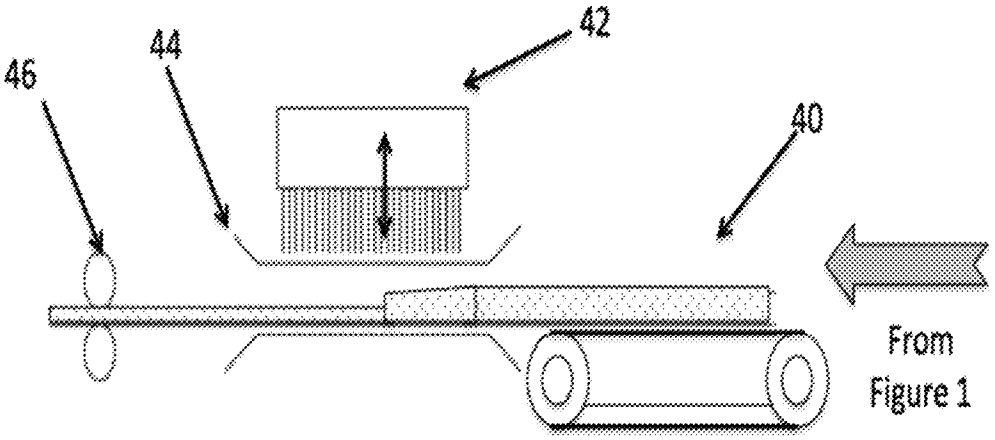
FIG. 3 is a schematic illustration of a method of needlepunching a nonwoven fabric.

The following definitions are presented for use in the interpretation of the claims and specification of the instant invention. Terms such as "comprising", "comprises", "including", "including but not limited to", "contains", "containing" are not to be considered as limiting or exclusive as related to the claimed invention. "A" and "an" are not be considered as indication enumeration when preceding an element or component. The terms "invention", "present invention" or "instant invention" are not limiting terms and are used to convey and incorporate all aspects described and discussed in the claims and the specification. The term "about" used as a modifier of a quantity refers to variations as are known and understood to occur in measuring and handling procedures as are known to those skilled in the arts of textile science and engineering. Additional definitions of technical terms and references follow.

Any ranges cited herein are inclusive. The term "about" used throughout is used to describe and account for small fluctuations. For instance, "about" may mean the numeric value may be modified by ±5%, ±4%, ±3%, ±2%, ±1%, ±0.5%, ±0.4%, ±0.3%, ±0.2%, ±0.1% or ±0.05%. All numeric values are modified by the term "about" whether or not explicitly indicated. Numeric values modified by the term "about" include the specific identified value. For example "about 5.0" includes 5.0.

Cellulosics, and cellulosic fibers refer to natural fibers or to synthetic fibers which are chemically ethers or esters of cellulose. Such natural fibers are obtained from the bark, wood, leaves, stems, or seeds of plants. Synthetic cellulosic fibers are manufactured from digested wood pulp and may include substituted side groups to the cellulose molecule that provide specific properties to those fibers.

Bast fibers are obtained from the phloem or bast from the stem of certain plants, including but not limited to jute, kenaf, flax and hemp. The bast fibers are initially recovered as bundles of individual fibers which are adhered by pectin, which must be subsequently removed to some degree to allow the bast fibers to be processed further.

Crimp is the naturally occurring convolution of waviness of a fiber, or that same property induced by chemical or mechanical means, such as crimping of synthetic fibers. The imposition of crimp to a specific frequency, as defined by a number of crimps per unit of fiber length.

Natural fibers are those sourced directly from plants, animals, or minerals, noting that such fibers may require specific pre-processing in order to render them useful for textile manufacturing purposes. Synthetic fibers are those produced through polymerization processes, using naturally occurring and sustainably sourced raw materials or petroleum derived raw materials.

Staple fibers are fibers with a discrete length and may be natural or synthetic fibers. Continuous fibers have an indeterminate or difficult to measure length, such as silk or those from certain synthetic fiber spinning processes. Fibers of any length may be cut into discrete lengths and that cut product is then referred to as a staple fiber.

Airlaid, sometimes referred to as air laid, is a processes for producing a fibrous mat or batt using short or long staple fibers, or blends of the same. In this process, air is used to transfer the fibers from the fiber opening and aligning section of the process and to then to convey those fibers to a forming surface where the fibrous mat or batt is collected and then subjected to a further step of bonding or consolidating to produce an airlaid nonwoven fabric.

Drylaid is a process for producing a fibrous mat or batt by a process using mechanical fiber opening and alignment, such as carding, where the fibrous mat or batt is transferred by mechanical rather than by means of air to a conveyor surface, where the fibrous mat or batt is then subjected to a further step of bonding or consolidating to produce a drylaid nonwoven fabric.

Wetlaid, sometimes referred to as wet laid, is a process for producing a fibrous sheet through means similar to paper making where the fibers are suspended in an aqueous medium and the web is formed by filtering the suspension on a conveyor belt or perforated drum. Depending on the end use application and fibers used to produce the fabric, some means of bonding or consolidating may be required to achieve final properties in the fabric.

Bonding or consolidation of fibrous mats or batts is a processing step that is common among the various technologies for producing nonwoven fabrics. The means of bonding or consolidation are commonly considered as being mechanical, thermal or adhesive, with several distinct methodologies existing under each of those headings. In general, mechanical means rely on creating entanglements between and among fibers to produce desired physical properties, where needlepunch and hydroentangling are nonexclusive examples of those means. Thermal bonding uses the thermoplastic properties of at least some fibers included in the fabric, such that the application of heat with or without pressure causes a portion of the fibers to soften and deform around each other and/or to melt and form a solid attachment between and among fibers at points of crossover when the thermoplastic material has cooled and solidified. Adhesive means use the application of adhesive in some form to create a physical bond between and among fibers at points of crossover, such means nonexclusively include liquid adhesives, dry adhesives, hot melt adhesives. These adhesives may be applied to mats or batts as sprays and foams, or via methods known in the art including but not limited to dip-and-squeeze or gravure roll.

A percentage by weight, in reference to a fabric, is the weight of given solid component divided by the total weight of the fabric, expressed as a percentage of the fabric weight.

Strength-to-weight ratio is an expression of a normalized tensile strength value for a fabric where the tensile strength of the fabric can then be considered relative to similar fabrics without the impact of basis weight differences between or among sample fabrics or grades of fabrics. Because basis weight alone can influence tensile strength values for a given fabric, the strength-to-weight ratio allows for an assessment of the impact on the strength of a fabric contributed by the inclusion of a specific fiber or a change in the process parameters, as non-exclusive examples of the usefulness of that metric.

Loft relies upon the properties of bulk and resilience for a fabric. In technical terms, bulk is the inverse of density, while in common usage bulk is equated to simple fabric thickness. Resiliency is the ability of a fabric to resist permanent compression, with loss of volume, following application of an areal load.

Quaternary ammonium compounds (QAC) are among the most widely used antimicrobial treatments available, having good stability and surface activity, low odor and reactivity with other cleaning, and good toxicology results. QACs are active against most bacteria, as well as some virus forms and certain fungi. Further, QACs are readily applied to surfaces, including the surfaces of fibers in a fabric construction, where it may be retained by those surfaces and also transferred from the fibers to other surfaces for the purpose of clean or disinfecting. While synthetic fiber surfaces are known to be essentially non-reactive with QACs, some cellulosic fibers, including bast fibers, react with QACs thereby reducing the efficacy of the QAC as a disinfecting and cleaning agent when those fibers are used in fabrics intended as wiping materials.

Compatibility with QAC is a consideration of the ability of a treated cellulose fiber to remain stable and not react with the QAC antimicrobial sanitizers.

The present invention relates to nonwoven fabrics formed and bonded by a variety of methodologies and means well known in the industry, where those nonwoven fabrics comprise at least a minority portion of bast fibers on which a planned crimp has been imparted and have a mean fiber length of at least 6 millimeters, where the bast fibers are substantially pectin free.

Figure 4:
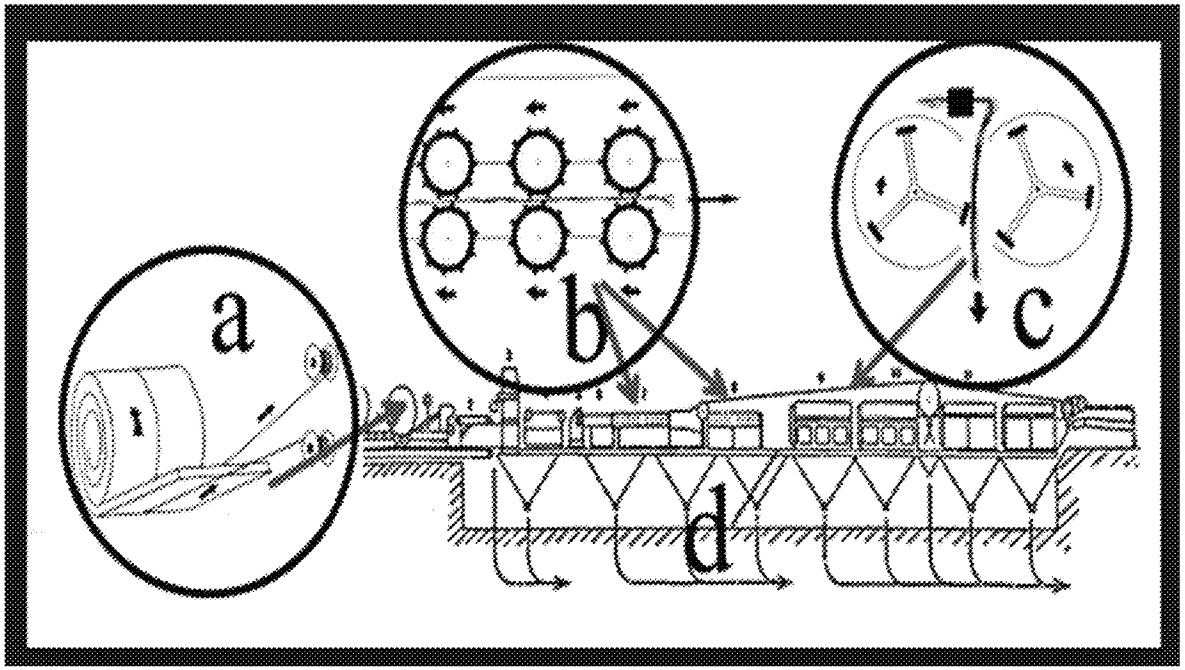
FIG. 4 is a schematic illustration of a method of mechanically cleaning bast fibers.

As noted above, bast fibers utilized in this disclosure can be individualized via mechanical or chemical cleaning. Mechanical cleaning of bast fibers occurs during a process called skutching or decortication. During this process the plant stems are broken and combed to remove non-fiber components such as hemicellulose, pectin, lignin, and general debris. This process is shown in [FIG. 4]. The bale of bast fiber is unrolled in to the machine a, breaker rolls b split the stems and expose the fiber bundles, and rotating combs c clean the fiber of all trash and non-fiber material. The fibers are then discharged to a separate collection area d. Decortication is a similar process that utilizes pinned cylinders in place of rotating combs. Mechanical cleaning individualizes the bast fibers and removes less pectin than chemically cleaning Mechanically cleaned fibers have had a portion of the pectin removed from the fiber and are considered by this application to be pectin reduced. The residual level of pectin/contaminants vary from geographic region and growing season and depends on the natural retting of the fiber and the number of rotating combs/pinned rollers that the fiber is subjected to. Mechanically cleaning bast fibers is commonplace and grades of pectin-reduced fiber are known to those skilled in the art.

Chemical cleaning of bast fibers occurs in several ways: water retting, chemical cleaning, or enzymatic cleaning. Natural chemical cleaning, called water retting, occurs in pools or streams whereby the bast fiber stalks are placed in the water for a period of several days to a week or more. Natural microbes remove the pectin from the fiber releasing the hemicellulose from the fiber resulting in clean, pectin reduced, individualized bast fiber. Chemical cleaning is a faster process and is performed on mechanically cleaned bast fibers and in an industrial facility possessing equipment capable of working at greater than atmospheric pressure and with temperatures ranging from 80° C. to over 130° C. The bast fiber is subjected to heat, pressure, and caustic soda or other cleaning agents to quickly remove pectin and lignin. Enzymatic cleaning is very similar to chemical cleaning with a portion of the caustic soda and other chemical agents being replaced by enzymes such as pectinase or protease.

Chemically cleaned bast fibers are considered by the industry to be substantially free of pectin. US2014/0066872 to Baer et al., which is incorporated by reference herein, describes fiber with substantially reduced pectin as having less than 10%-20% by weight of the pectin content of the naturally occurring fibers from which the substantially pectin-free fibers are derived.

In a preferred embodiment of the invention, the crimp level of the crimped bast fibers in the nonwoven fabric has been induced by either mechanical or chemical means of about 1 to 8 crimps per centimeter, and where some portion of fibers shorter than one centimeter in length may still exhibit at least 1 crimp.

Such chemical means for inducing controlled crimp include but are not limited to exposure to strong acid or strong base baths. Such mechanical means for inducing crimp include but are not limited to edge crimping, gear crimping, stuffer boxes, and knit-deknitting.

Figure 5:
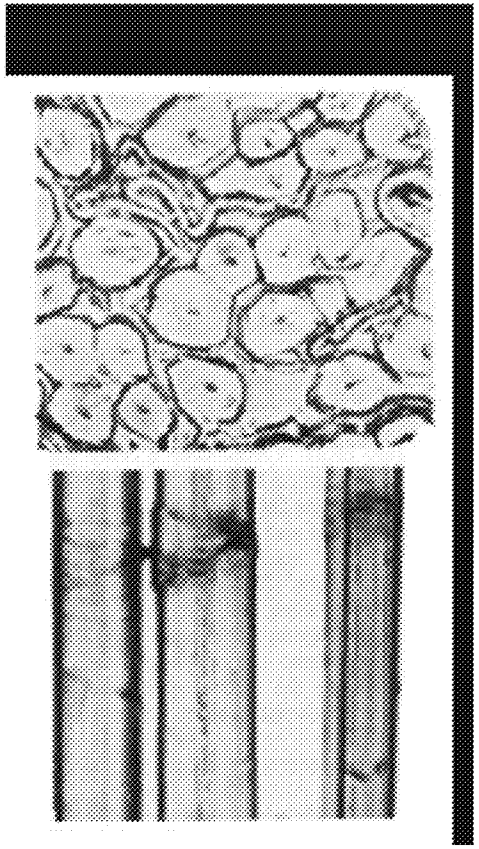
FIG. 5 is an image of substantially straight, naturally-occurring bast fibers.

FIG. 5 shows naturally straight bast fibers. Bast fibers are substantially straight and, as a result, exhibit poor fiber-to-fiber cohesion.

Figure 6:
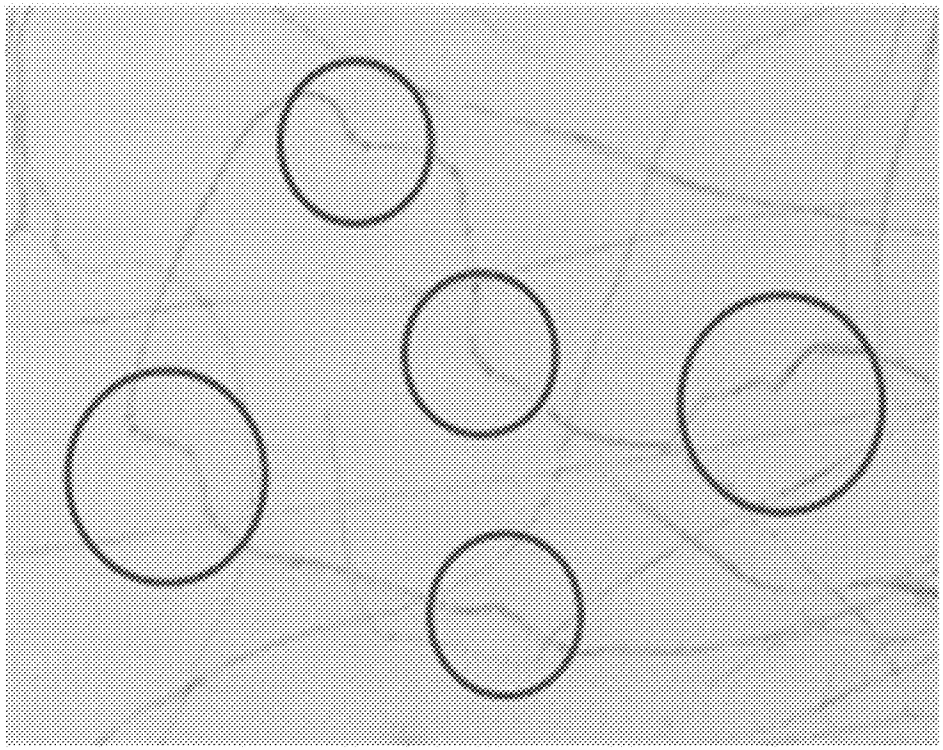
FIG. 6 is a Scanning Electron Microscopy (SEM) image of a crimped bast fiber according to an embodiment of the invention.

FIG. 6 shows examples of bast fibers that have been subjected to crimp. The circles indicate various crimps appearing in the image.

Figure 7:
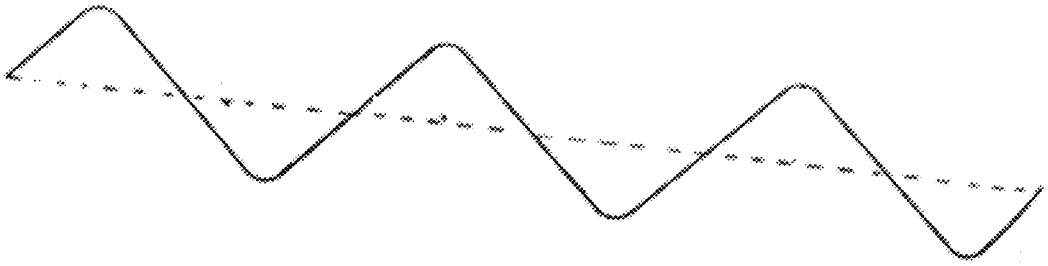
FIG. 7 is an illustration of a fiber with a planar crimp.

FIG. 7 shows a diagram of a mechanical planar crimp. Crimp angle and number of crimps per centimeter are determined by the method of mechanical crimping.

The inclusion of crimp bast fibers in at least a minority portion of the total weight of fibers in the bast fiber nonwoven fabric, provides improved processing efficiency and improved physical properties of those fabrics as compared to similarly formed fabrics with the same portion of straight bast fibers. The improved physical properties include but are not limited to the fabric loft and the fabric strength-to-weight ratio.

In one embodiment of the invention, the nonwoven fabric contains at least about 5% by weight of crimped bast fibers, with a majority of other staple fibers selected from natural or synthetic fiber types. This bast fiber nonwoven fabric of this embodiment exhibits the described improvement in physical properties as compared to a bast fiber nonwoven fabric that does not include crimped bast fibers.

In a further preferred embodiment of the application, the crimped bast fibers may be blended with one or more other types of natural or synthetic staple fibers at a weight percent of at least about 5% to 49% crimped bast fibers with a mean length of greater than 6 mm to form the nonwoven fabric.

In another preferred embodiment, the crimped bast fibers may be blended with one or more other types of natural or synthetic staple fibers at a weight percent of at least about 51% to 100% crimped bast fibers with a mean length of greater than 6 mm to form the nonwoven fabric, with the other natural or synthetic fibers comprising about 49% to 0% of the fabric weight.

In a most preferred embodiment of the invention, the inclusion of at least about 5% by weight of the crimped bast fibers with a mean length of greater than 6 mm in the fabric provides an improvement in the strength-to-weight ratio and improved loft as compared to other similarly manufactured bast fiber containing nonwoven fabrics where those bast fibers are essentially straight and do not exhibit crimp.

It is a further embodiment of the invention that the one or more types of natural fibers included in a blend with the crimped bast fibers may include bast fibers that do not exhibit a minimum of 1 crimp per centimeter of fiber length.

It is an aspect of the present invention that the crimped bast fiber nonwoven fabric may be produced by any of the drylaid, airlaid or wetlaid nonwoven technologies and may be bonded or consolidated by any of the adhesive, mechanical or thermal bonding means. It is understood that such means may be used in combination to produce the final fabric form, where for example a carded mat or batt might be combined with an airlaid mat or batt where either layer or the laminate may be subjected to one or more of the bonding or consolidating means in order to produce the desired physical and aesthetic properties of the final fabric.

In certain embodiments, the bast fiber nonwoven fabric may be a laminate of at least two nonwoven fabrics in a laminate where at least one fabric of the laminated comprises at least 5% of crimped bast fibers and where each of the fabrics may be formed by drylaid, airlaid or wetlaid forming processes and where each of the fabrics may be bonded by thermal, mechanical or adhesive means prior to forming the laminate configuration.

It is a further embodiment of the present disclosure that bast fibers may be coated with one or more thermoplastic polymer resin to provide a bast fiber nonwoven fabric that is compatible with QAC sanitizers. The purpose of the thermoplastic polymer resin coating is to protect the QAC from deactivation by interaction with the surface chemistry of the bast fibers. Such pretreatment followed contact with QAC produces a bast fiber nonwoven fabric with improved efficacy of antimicrobial activity as compared to other bast fiber nonwoven webs that have not been so pretreated before contact with QAC. In addition, coating the bast fibers in one or more thermoplastic polymers and then subjecting those fibers to crimp improves the permanency of the crimp. Crimp permanency ensures that the desirable performance properties of the crimped bast fibers remain stable and present throughout the nonwoven fabric formation process.

It is an aspect of the present invention that the controlled crimp bast fiber nonwoven fabrics as described herein will be find use end product applications including but not limited to baby wipes, cosmetic wipes, perinea wipes, disposable washcloths, kitchen wipes, bath wipes, hard surface wipes, glass wipes, mirror wipes, leather wipes, electronics wipes, disinfecting wipes, surgical drapes, surgical gowns, wound care products, protective coveralls, sleeve protectors, diapers and incontinent care and feminine care articles, nursing pads, air filters, water filters, oil filters, furniture or upholstery backing.

The foregoing is considered to provide examples of the principles of the invention. The scope of modifications as may be made to the invention are not limited beyond that imposed by the prior art and as set forth in the claims herein.

What is claimed is:

1. A bast fiber nonwoven fabric comprising at least about 5% bast fibers, where said bast fibers have a mean length of greater than about 6 mm and are coated to render the fiber compatible with quaternary ammonium (QAC) based sanitizers, wherein the bast fibers have been chemically or mechanically treated to impart a crimp of about 1 to about 8 crimps per centimeter, wherein the bast fibers have been coated with a polyester thermoplastic resin that is biodegradable.

2. The bast fiber nonwoven fabric of claim 1, wherein the coating improves the surface compatibility of the bast fibers with said quaternary ammonium (QAC) based sanitizers.

3. The bast fiber nonwoven fabric of claim 1, where said thermoplastic resin coating does not degrade the antimicrobial activity of said quaternary ammonium (QAC) based sanitizers.

4. The bast fiber nonwoven fabric of claim 1, where the nonwoven fabric is a drylaid, airlaid or wetlaid nonwoven bonded by one or more of thermal bonding, mechanical bonding, or adhesive bonding.

5. The bast fiber nonwoven fabric of claim 1, where said bast fibers are blended with at least one type of natural or synthetic staple fibers at a level of 5-49% bast fibers by weight.

6. The bast fiber nonwoven fabric of claim 1, where said bast fibers are blended with at least one type of natural or synthetic staple fibers at a level of at least about 51-100% of said bast fibers by weight.

7. The bast fiber nonwoven fabric of claim 1, where said bast fibers have been treated to remove naturally occurring pectin.

8. A bast fiber nonwoven fabric comprising at least about 5% bast fibers, where said bast fibers have a mean length of greater than about 6 mm and are coated with a polyester thermoplastic resin to render the fiber compatible with quaternary ammonium (QAC) based sanitizers, wherein the polyester thermoplastic resin is biodegradable.

9. A bast fiber nonwoven fabric comprising at least about 5% bast fibers, where said bast fibers have a mean length of greater than about 6 mm and are coated to render the fiber compatible with quaternary ammonium (QAC) based sanitizers, wherein the coating improves the surface compatibility of the bast fibers with said quaternary ammonium (QAC) based sanitizers.

10. A bast fiber nonwoven fabric comprising at least about 5% bast fibers, where said bast fibers have a mean length of greater than about 6 mm and are coated with a thermoplastic resin to render the fiber compatible with quaternary ammonium (QAC) based sanitizers, where said thermoplastic resin coating does not degrade the antimicrobial activity of said quaternary ammonium (QAC) based sanitizers.

11. The bast fiber nonwoven fabric of claim 1, wherein the bast fibers are extracted from flax, hemp, jute, ramie, nettle, Spanish broom, kenaf plants, or any combination thereof.

12. The bast fiber nonwoven fabric of claim 1, further comprising natural staple fibers, man-made staple fibers, or a combination thereof, the staple fibers being crimped or uncrimped.

13. The bast fiber nonwoven fabric of claim 4, where the thermal bonding includes one or more of calendering, thermal point bonding, through-air bonding, and sonic bonding.

14. The bast fiber nonwoven fabric of claim 4, where the mechanical bonding includes one or both of needlepunching and hydroentangling.

15. The bast fiber nonwoven fabric of claim 4, wherein the adhesive bonding includes one or more of coating, spraying, dip-and-squeeze, gravure roll, foam bonding, powder bonding, and hot melt adhesive application.

* * * * *